US005886600A

United States Patent [19]

Larranaga et al.

[11] Patent Number: 5,886,600

[45] Date of Patent: Mar. 23, 1999

[54] MODULAR THERMAL MAGNETIC TRIP UNIT FOR RAPID CIRCUIT INTERRUPTION

[75] Inventors: Javier I. Larranaga, Bristol; Joseph Criniti, New Britain; William A. Newton, Jr., Plainville, all of Conn.

[73] Assignee: General Electric Company, Schenectady, N.Y.

[21] Appl. No.: 6,797

[22] Filed: Jan. 14, 1998

[51] Int. Cl.[6] ..... H01H 75/12

[52] U.S. Cl. ..... 335/35; 335/38

[58] Field of Search ..... 335/23–5, 35.8, 335/42, 45, 167–176

[56] References Cited

U.S. PATENT DOCUMENTS 3,421,123 1/1969 Johnson et al. ..... 335/35

3,760,308 9/1973 Misencik et al. ..... 335/43

4,513,268 4/1985 Seymour et al. ..... 335/35

*Primary Examiner*—Lincoln Donovan

*Attorney, Agent, or Firm*—Fishman, Dionne, Cantor & Colburn; Carl B. Horton

[57] ABSTRACT

A modular thermal magnetic trip unit includes the bimetal, magnet, armature and latch in a one-piece assembly. A latch opening is formed in a bottom part of the magnet on a side opposite the bimetal for receiving and retaining the tip of the cradle. The motion of the inodular assembly is accelerated by the combined thermal and magnetic forces acting in unison.

10 Claims, 3 Drawing Sheets

MODULAR THERMAL MAGNETIC TRIP UNIT FOR RAPID CIRCUIT INTERRUPTION

BACKGROUND OF THE INVENTION

Residential circuit interruption is efficiently accomplished within residential circuit breakers containing a thermal-magnetic trip unit, an operating cradle and a pair of separable contacts. The thermal response is provided by means of a bi-metal element that is electrically-connected in series with the separable contacts for so-called "long time" current sensing and the magnetic response is provided by a stationary magnet that partially surrounds the bimetal and interfaces with a movable armature that carries the cradle retention latch for so-called "short time" current sensing. A good example of a residential circuit breaker including a thermal-magnetic trip unit is found in U.S. Pat. No. 4,513,268 entitled Automated Q-Line Circuit Breaker".

Various enhancements are available for enhancing the magnetic response and allowing short time protection at lower ampere ratings. One such enhancement is found in U.S. patent application Ser. No. 08/804,045 filed Feb. 21, 1997 entitled "Residential Circuit Breaker Having an Enhanced Thermal-Magnet Trip Unit".

Efforts to enhance both the thermal and magnetic response of low cost residential circuit breakers often result in a cost increase due to additional components and increased manufacturing time.

Accordingly, it would be economically feasible to enhance both the thermal and magnetic response within such residential circuit breakers without incurring a corresponding cost increase.

One purpose of the invention is to describe one such thermal-magnetic trip unit having enhanced thermal and magnetic response at a savings in both component cost and in manufacturing time.

SUMMARY OF THE INVENTION

A modular thermal magnetic trip unit includes the bi-metal, magnet, armature and latch in a one-piece assembly. A top part of the bi-metal is attached to a top part of the magnet at one point to provide clearance there between. A latch opening is formed in a bottom part of the magnet on a side thereof opposite the bimetal for receiving and retaining the tip of the cradle. The motion of the modular assembly is accelerated by the combined thermal and magnetic forces acting in unison.

DESCRIPTION OF THE PREFERRED EMBODIMENT

Figure 1:
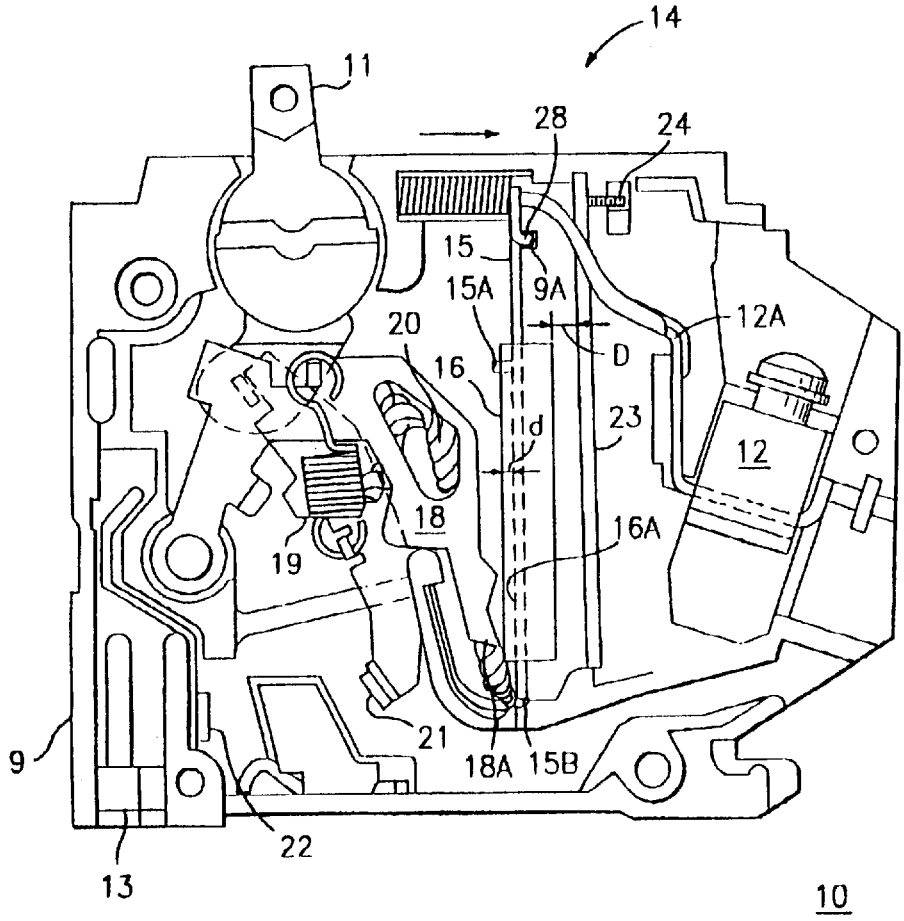
FIG. 1 is a front planar view of a circuit breaker containing the modular thermal magnetic trip unit in accordance with the invention.
Figure 1A:
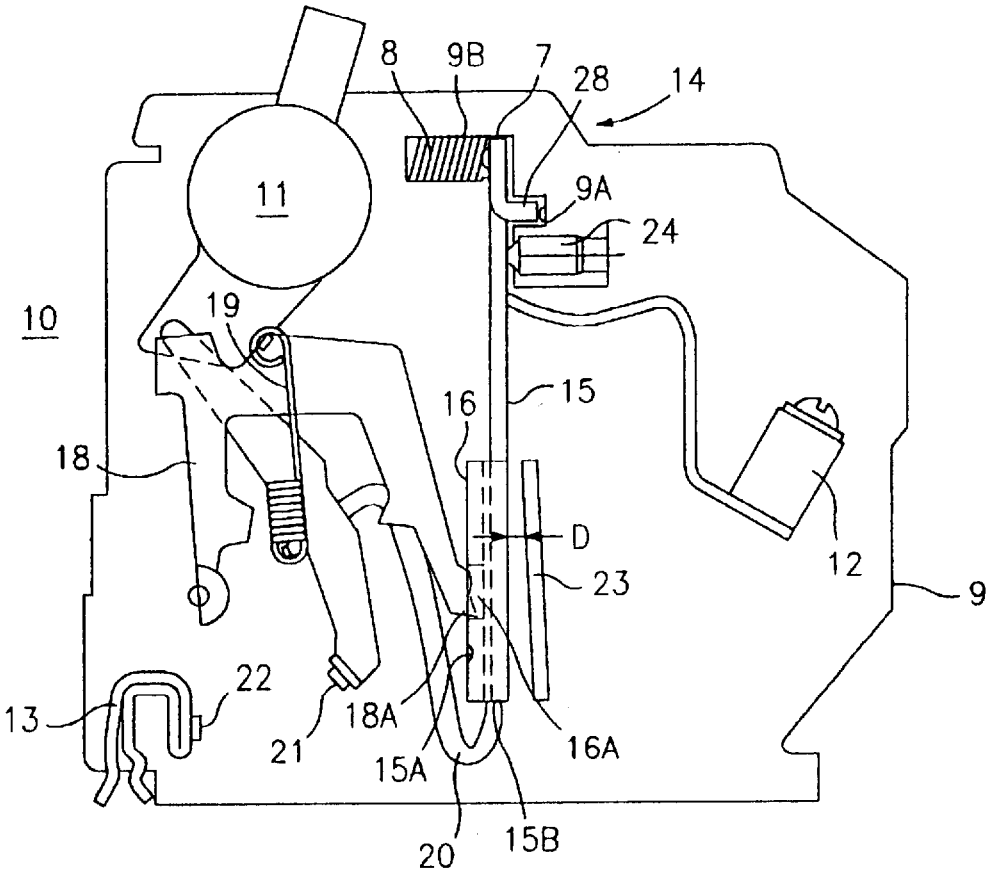
FIG. 1A is a rear planar view of FIG. 1.

A residential circuit breaker 10 is shown in FIG. 1 and consists of a plastic case 9 which electrically connects with an electric circuit by means of a load connector 12 and a line connector 13 arranged at opposite ends thereof The circuit breaker is similar to that described within the aforementioned U.S. Pat. No. 4,513,268 with the circuit breaker cover removed to depict a pair of movable and fixed contacts 21, 22 which become separated upon articulation of the cradle 18 and operation of the charged operating spring 19. In accordance with the teachings of tile invention, the modular trip unit 14 includes a bimetal 15 that connects between the load strap 12A the flexible braid 20, as indicated at 15B, to complete the electric circuit between the load and line connectors 12, 13. The top of the bimetal plate is shaped to define a tab 28 that extends within a slot 9A formed in the circuit breaker case to pivotally support the modular trip unit 14 while the spring 8 within a separate slot 9B accurately aligns the bimetal plate in the vertical plane. The bimetal plate 15 is attached to the U-shaped magnet metal plate 16 by means of projection welding as indicated at 15A to define a clearance spaced between the magnet and the bimetal and allow independent motion by the bimetal and the magnet. The term "magnet metal" herein includes any metal such as iron, nickel and their oxides that are receptive to a magnetic field. A latch slot 16A is formed on the rear surface of the magnet to support the cradle tip 18A of the cradle 18 and serves to retain the charged operating spring 19 from separating the contacts 21, 22 , when closed , in the manner described within aforementioned U.S. Pat. No. 4,513,268. The front surface of the magnet is positioned next to a metal strap 23 and a magnetic gap D is defined there between to ensure movement of the magnet in the direction of the metal strap upon generation of an electromagnetic field external to the current-carrying bimetal and the concentration of the resultant magnetic field generated within the magnet in proportion to the current. The calibrating screw 24, manually accessible from outside the case allows the modular trip unit 14 to be adjusted for the calibration of the engagement of the latch slot 16A to the cradle tip 18A. Upon occurrence of an overcurrent condition within the protected circuit, the current transfer through the bimetal 15 causes the bimetal to heat and flex in the indicated direction towards the low expansion side of bimetal. At the same time, the magnetic force generated within the magnet motivates the magnet in the same direction toward the metal plate 23.

Figure 2:
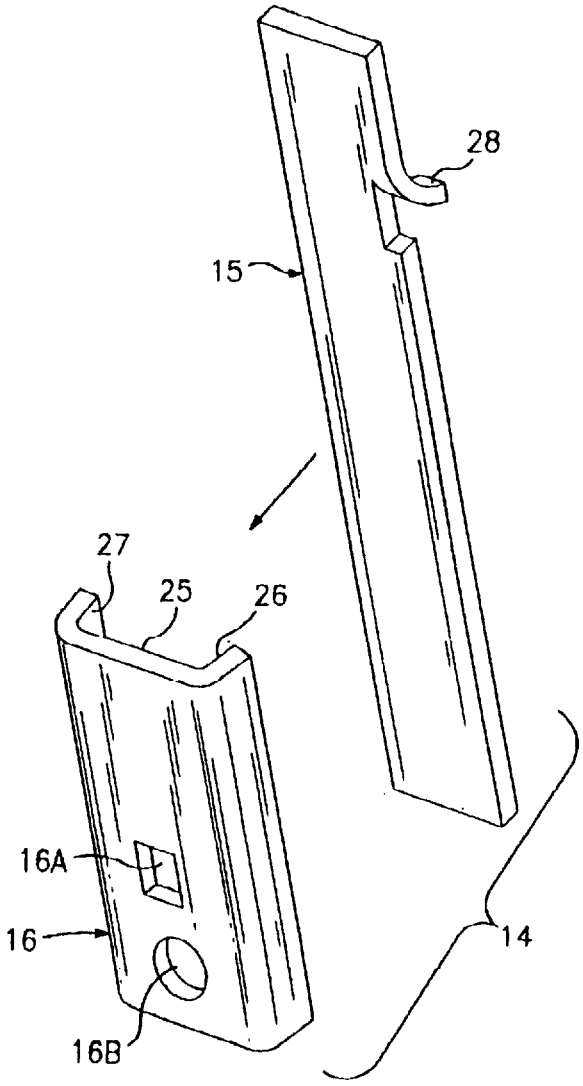
FIG. 2 is a top perspective view of the modular thermal magnetic trip unit of FIG. 1 with the components in isometric projection.

The attachment of the bimetal 15 to the magnet 16 of the modular trip unit 14 is seen by now- referring to FIG. 2. The tab 28 is shaped from the bimetal to serve as a support within the circuit breaker case 9 as shown earlier in FIG. 1. The magnet 16 is formed to define a U-shaped configuration with a planar bight 25 having up-standing rails 26, 27 at opposite ends thereof. The rectangular latch slot 16A is formed above the circular attachment slot 16B to which the projection weld described earlier is applied to join the bimetal to the magnet at a single point. Prior to welding the bimetal to the magnet, the bimetal is inserted between the up-standing rails 26, 27 in tight fit to insure that the bimetal and magnet move in unison under the combined thermal and magnetic overcurrent displacement forces.

It has been determined that the combined movement of the bimetal and magnet substantially improves the response of the trip unit, per se, for interrupting current at lower values then heretofore attainable with standard thermal magnetic trip units.

We claim:

1. A thermal magnetic trip unit comprising:

a bimetal plate pivotally-arranged for movement in a first plane in response to current transport through said bimetal;

a first magnet metal plate attached at one end to said bimetal plate and extending parallel to said bimetal plate;

a retainer slot formed within a rear surface of said first magnet plate and arranged for receiving a tip of a circuit breaker operating cradle therein; and a second metal plate adjacent a front surface of said first magnet plate, whereby said first magnet plate moves toward said second metal plate upon said current transport through said bimetal plate.

2. The thermal magnetic trip unit of claim 1 wherein said first magnet metal plate defines a separation distance between said first magnet metal plate and said bimetal plate.

3. The thermal magnetic trip unit of claim 2 wherein said first magnet metal plate defines a magnetic gap between said second magnet metal plate and said first magnet metal plate.

4. The thermal magnetic trip unit of claim 3 further including means for positioning said first metal plate relative to said cradle tip for purposes of calibration.

5. The thermal magnetic trip unit of claim 4 wherein said positioning means comprises an externally -accessible calibration screw.

6. A circuit breaker comprising:

an electrically-insulative enclosure;

a pair of separable contacts within said enclosure, said contacts being arranged for connection with a protected electric circuit;

an operating spring within said enclosure, said operating spring being arranged for driving said contacts from a CLOSED to an OPEN position;

an operating cradle pivotally arranged within said enclosure, said operating spring being connected with said operating cradle whereby said operating cradle retains said operating spring in a charged position when said contacts are in said CLOSED position;

a bimetal plate within said enclosure, said bimetal plate being pivotally-arranged for movement in a first plane in response to current transport through said bimetal plate;

a first magnet metal plate attached at one end to said bimetal plate and extending parallel to said bimetal plate;

a retainer slot formed within a rear surface of said first magnet plate and arranged for receiving a tip formed at one end of said circuit breaker operating cradle therein; and a second metal plate adjacent a front surface of said first magnet plate, whereby said first magnet plate moves toward said second metal plate upon said current transport through said bimetal plate.

7. The circuit breaker of claim 6 wherein said first magnet metal plate defines a separation distance between said first magnet metal plate and said bimetal plate.

8. The circuit breaker of claim 7 wherein said first magnet metal plate defines a magnetic gap between said second magnet metal plate and said first magnet metal plate.

9. The circuit breaker of claim 8 further including means for positioning said first metal plate relative to said cradle tip 18A for purposes of calibration.

10. The circuit breaker of claim 9 wherein said positioning means comprises a calibration screw.

* * * * *